US009784208B2

(12) United States Patent
Morgan

(10) Patent No.: US 9,784,208 B2
(45) Date of Patent: Oct. 10, 2017

(54) CYLINDER LINER HAVING ROLL-BURNISHED RECESS

(71) Applicant: Caterpillar Inc., Peoria, IL (US)

(72) Inventor: Bradley Lee Morgan, Chillicothe, IL (US)

(73) Assignee: Caterpillar Inc., Peoria, IL (US)

( * ) Notice: Subject to any disclaimer, the term of this patent is extended or adjusted under 35 U.S.C. 154(b) by 334 days.

(21) Appl. No.: 14/315,247

(22) Filed: Jun. 25, 2014

(65) Prior Publication Data

US 2015/0377177 A1 Dec. 31, 2015

(51) Int. Cl.
*F02F 1/00* (2006.01)
*C21D 7/08* (2006.01)

(52) U.S. Cl.
CPC ..... *F02F 1/004* (2013.01); *C21D 7/08* (2013.01); *F02F 2001/008* (2013.01)

(58) Field of Classification Search
CPC ..... F02F 1/004; F02F 2001/008; F02F 1/00; C21D 7/08; C21D 7/04
See application file for complete search history.

(56) References Cited

U.S. PATENT DOCUMENTS 2,818,359 A * 12/1957 La Belle ..... C21D 7/04 148/544
6,732,699 B2 5/2004 Wakade et al.
2004/0065290 A1* 4/2004 Wakade ..... F02F 1/004 123/193.2
2012/0304954 A1 12/2012 Kiser et al.

OTHER PUBLICATIONS

Tristar, Burnishing Tools, Roller Burnishing Process, Mar. 20, 2006, "https://web.archive.org/web/20060320093557/http://www.tristarindia.com/burnishing/processnew.html".*

* cited by examiner

*Primary Examiner* — Kevin Lathers
(74) *Attorney, Agent, or Firm* — Finnegan, Henderson, Farabow, Garrett & Dunner, LLP

(57) ABSTRACT

A cylinder liner is disclosed. The cylinder liner may include a hollow generally cylindrical body extending from a top end to a bottom end along a longitudinal axis, and an annular flange extending radially outwardly from the top end of the body. The cylinder liner may also include an annular recess adjacent the flange at a side closest to the bottom end of the body. The recess may have first and second axial ends, a substantially straight portion extending between the first and second axial ends, and at least one fillet formed at an intersection between the straight portion and at least one of the first and second axial ends. A roll-burnishing operation may be performed on the straight portion and the at least one fillet in a direction along the longitudinal axis.

5 Claims, 4 Drawing Sheets

CYLINDER LINER HAVING ROLL-BURNISHED RECESS

TECHNICAL FIELD

The present disclosure relates generally to a cylinder liner and, more particularly, to a cylinder liner having a roll-burnished shoulder.

BACKGROUND

An internal combustion engine, such as a diesel or gasoline engine, includes a cylinder block defining a plurality of cylinder bores. Pistons reciprocate within the cylinder bores to generate mechanical power. Typically, each cylinder bore includes a replaceable cylinder liner. The cylinder liner includes a cylindrical body that fits within the cylinder bore. The cylinder liner may also include a radial flange at a top end of the body that supports the cylinder liner on the engine block.

High stresses are induced in the cylinder liner during installation of the cylinder liner in the engine block and during operation of the engine. These stresses may be especially high near the flange that supports the cylinder liner on the engine block. Because of these high stresses, regions of the cylinder liner proximate the flange are prone to fatigue failure. Therefore, various strengthening operations may be performed on the cylinder liner to increase its strength in this critical region.

One exemplary operation used to increase the strength of the cylinder liner is disclosed in U.S. Pat. No. 6,732,699 to Wakade et al. that issued May 11, 2004 (the '699 patent). Specifically, the '699 patent discloses a cast iron cylinder liner with a radial upper flange having an arcuate fillet formed at the junction between the flange and an exterior surface of the cylinder liner. In the cylinder liner of the '699 patent, a portion of the material adjacent the arcuate fillet is laser hardened to increase the fatigue resistance of the material in this region.

Although using laser hardening in this region may increase the fatigue life of the cylinder liner, this approach may be less than optimal. For instance, implementation of laser hardening may increase the cost of the cylinder liner. Additionally, in some applications, a potential failure initiation site of the cylinder liner may not be easily accessible for laser hardening.

The cylinder liner of the present disclosure solves one or more of the problems set forth above and/or other problems in the art.

SUMMARY

In one aspect, a cylinder liner is disclosed. The cylinder liner may include a hollow generally cylindrical body extending from a top end to a bottom end along a longitudinal axis, and an annular flange extending radially outwardly from the top end of the body. The cylinder liner may also include an annular recess adjacent the flange at a side closest to the bottom end of the body. The recess may have first and second axial ends, a substantially straight portion extending between the first and second axial ends, and at least one fillet formed at an intersection between the straight portion and at least one of the first and second axial ends. A roll-burnishing operation may be performed on the straight portion and the at least one fillet in a direction along the longitudinal axis.

In another aspect, a method of making a cylinder liner is disclosed. The method may include fabricating a hollow generally cylindrical body that extends from a top end to a bottom end along a longitudinal axis and an annular flange extending radially outwardly from the top end of the body. The method may also include performing a roll-burnishing operation along the longitudinal axis to form an annular recess adjacent the flange at a side closest to the bottom end of the body.

In yet another aspect, a cylinder liner is disclosed. The cylinder liner may include a hollow generally cylindrical body extending from a top end to a bottom end along a longitudinal axis, and an annular flange extending radially outwardly from the top end of the body. The method may also include an annular recess adjacent the flange at a side closest to the bottom end of the body. The recess may have a first fillet formed at an intersection between the flange and the recess, a second fillet formed at an intersection between the recess and an outer surface of the cylinder liner, and a substantially straight portion extending between and tangential with the first and second fillets. A roll-burnishing operation may be performed on the straight portion and at least one of the first and second fillets in a direction along the longitudinal axis.

DETAILED DESCRIPTION

Figure 1:
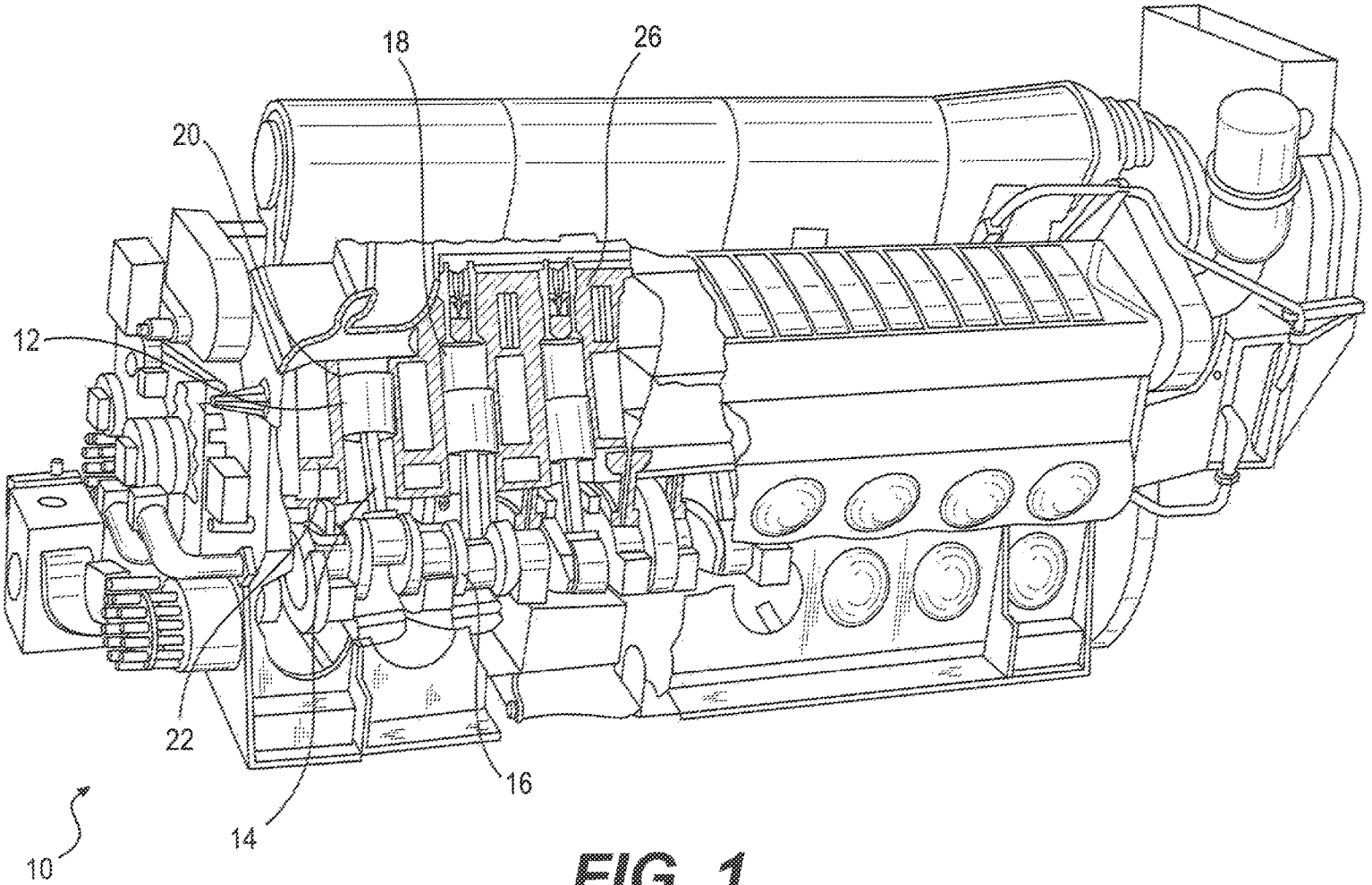
FIG. 1 is a cut-away perspective view illustration of an exemplary disclosed engine.

FIG. 1 illustrates an exemplary embodiment of an engine 10 that may be, for example, a diesel engine, a gasoline engine, or a gaseous fuel-powered engine. In the disclosed embodiment, engine 10 is a four-stroke diesel engine. One skilled in the art will recognize, however, that engine 10 may be any other type of combustion engine such as, for example, a two or four-stroke gasoline or gaseous fuel-powered engine.

Engine 10 may include, among other things, an assembly of pistons 12, connecting rods 14, and a crankshaft 16. Each piston 12 may be connected to crankshaft 16 by a corresponding one of connecting rods 14, such that movement of piston 12 results in rotation of crankshaft 16. These components may operate together to transform chemical energy in fuel into rotational motion of crankshaft 16 through a series of explosions within combustion chambers 18 of engine 10. These explosions may cause pistons 12 and connecting rods 14 of engine 10 to reciprocate within cylinders 20. In this manner, cylinders 20 may serve as pressure vessels in which the process of combustion takes place and as guides for pistons 12 sliding within them.

Cylinders 20 may be arranged within an engine block 22 in two banks positioned at an angle to each other. Each bank may include a group of cylinders 20 located on the same side of crankshaft 16 with their axes lying in a common plane passing through an axis of crankshaft 16. Each cylinder 20 may be sealed at its top by a cylinder head 26. Piston 12, reciprocable within cylinder 20, may thus define a variable-volume combustion chamber 18.

Figure 2:
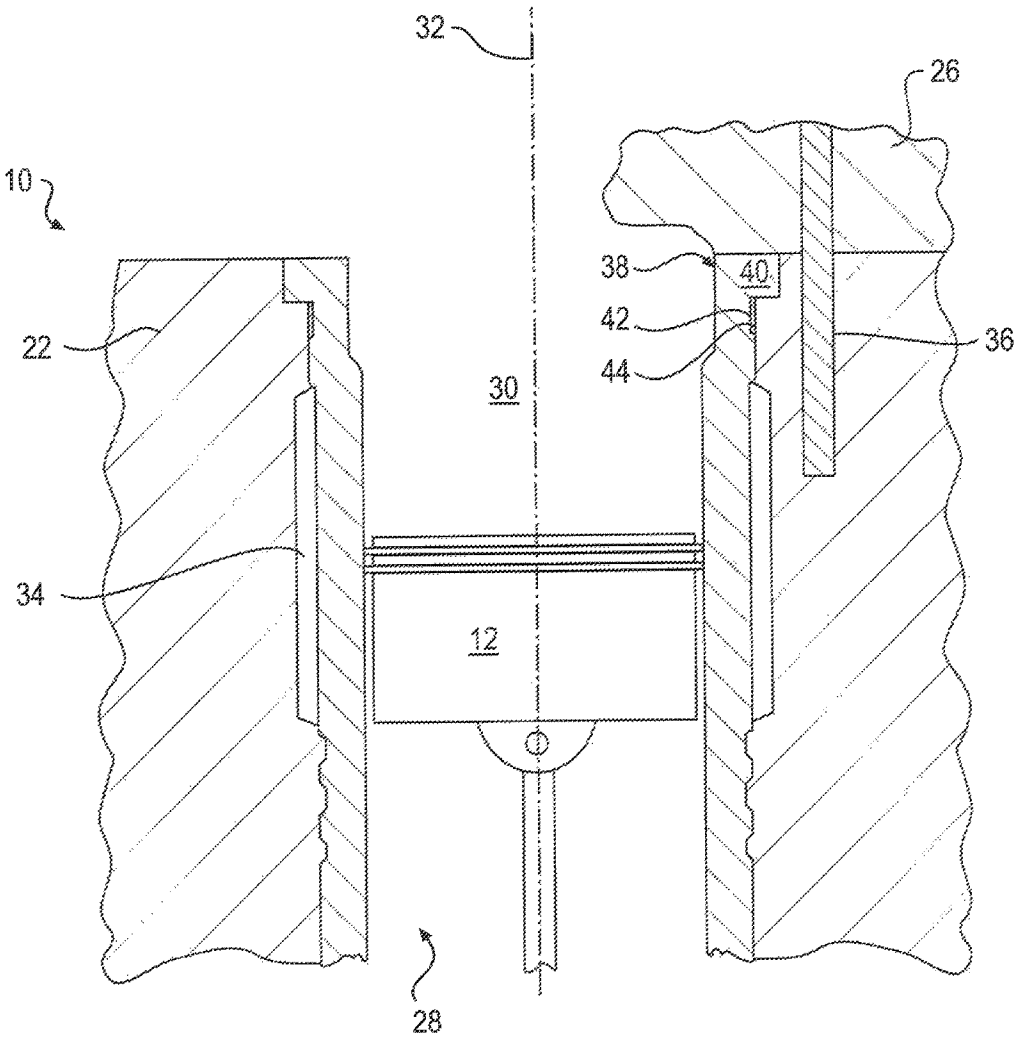
FIG. 2 is a cross-sectional view of an exemplary disclosed cylinder liner that may be used in conjunction with the engine of FIG. 1.

FIG. 2 illustrates a cross-sectional view of an exemplary cylinder liner 28 that may be used to protect an associated cylinder 20 from wear and degradation caused by piston 12. Cylinder liner 28 may be removably mounted within a piston bore 30, in which piston 12 reciprocates. Cylinder liner 28 may have a hollow generally cylindrical body extending along a longitudinal axis 32. During operation of engine 10, cylinder liner 28 may form a sliding surface for piston 12 as piston 12 is driven in an up-and-down reciprocating motion by connecting rod 14 and crankshaft 16 (shown in FIG. 1). As combustion occurs in combustion chamber 18, cylinder liner 28 may be heated. Engine block 22 may include a coolant jacket or cavity 34, which circulates coolant (e.g., water, glycol, or a blended mixture) along an outer surface of cylinder liner 28, to cool cylinder liner 28. In some embodiments, cylinder liner 28 may be cooled by other methods known in the art. Additionally, one or more fasteners 36 may be used to secure cylinder head 26 to engine block 22. In the disclosed embodiment, fastener 36 may embody a bolt, however, any other fastener known in the art may be used, as desired.

Cylinder liner 28 may be made of any type of steel or cast iron. In some embodiments, cylinder liner 28 is made of ductile or nodular iron. In other embodiments, cylinder liner 28 is made of steel or another type of cast iron, such as gray cast iron or vermicular iron. In the disclosed embodiment, cylinder liner 28 is made of gray cast iron.

As shown in FIG. 2, cylinder liner 28 may also include an annular shoulder 38 located at a top end of the cylinder liner 28. Shoulder 38 of cylinder liner 28 may include an annular flange 40 extending radially outward from the top end of the cylinder liner 28. An outer surface of flange 40 may mate with an annular step-like mounting surface formed in engine block 22 to secure cylinder liner 28 in place and to prevent cylinder liner 28 from sliding down further into bore 30.

Shoulder 38 may also include an annular recess 42 adjacent to flange 40. More specifically, recess 42 may be formed adjacent to flange 40 at a side closest to a bottom end of cylinder liner 28. Recess 42 may be configured to receive a ring-shaped seal 44 that is provided between recess 42 and engine block 22. Seal 44 may be configured to seal off water and/or oil from leaking into combustion chamber 18. In some embodiments, seal 44 may embody an O-ring, however, any other seal known in the art may be used, as desired.

Figure 3:
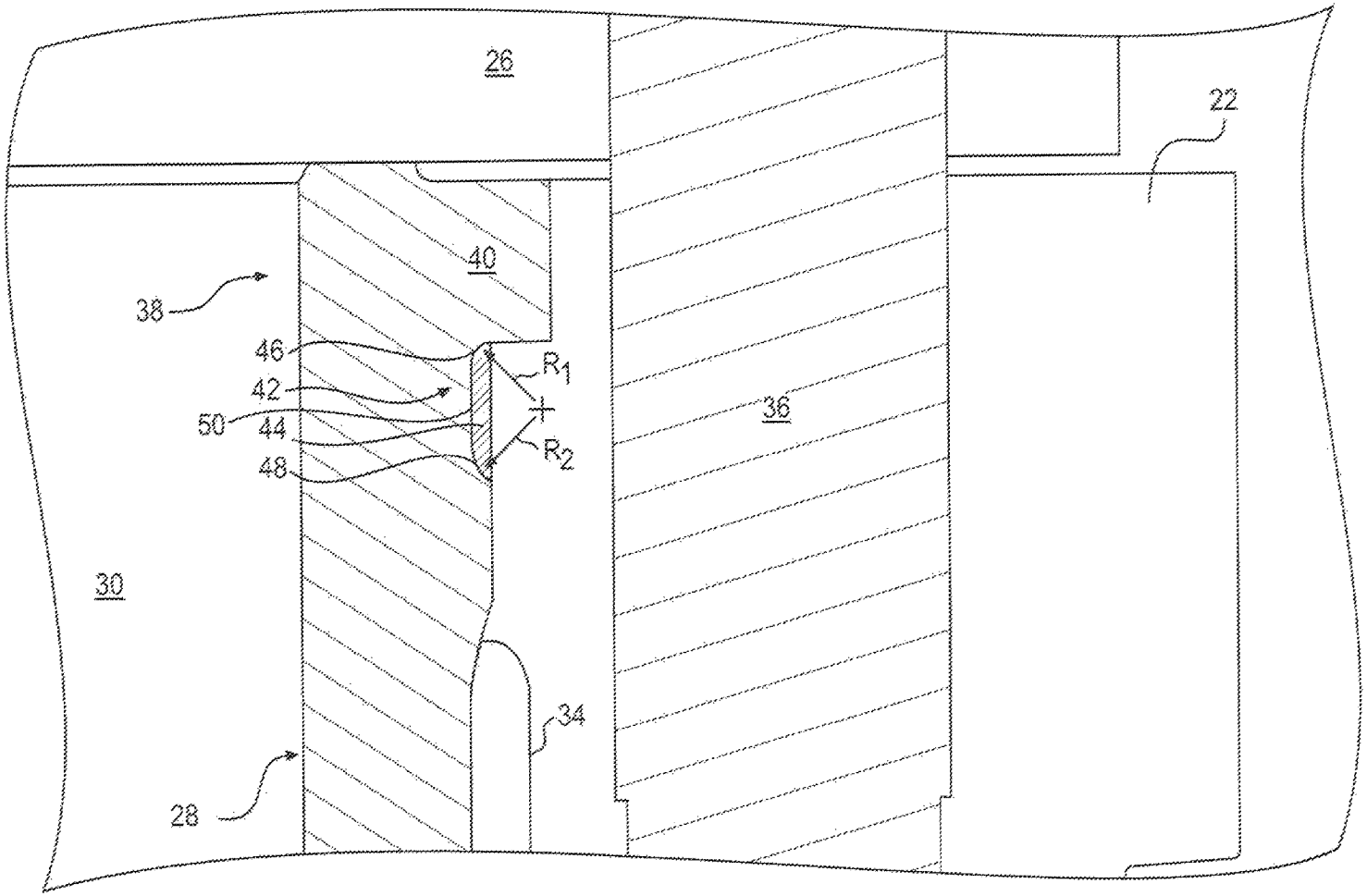
FIG. 3 is a cross-sectional view of a shoulder of the cylinder liner of FIG. 2.

As shown in FIG. 3, recess 42 may include at least one fillet and a substantially straight portion 50. For example, a first fillet 46 may be formed at a first axial end of recess 42 where flange 40 intersects recess 42, and a second fillet 48 may be formed at a second axial end of recess 42 where recess 42 intersects an outer surface of cylinder liner 28. Straight portion 50 may extend between fillets 46, 48 to form a wall of recess 42. More specifically, straight portion 50 may be tangential with fillet 46 and with fillet 48. Together, fillets 46, 48 and straight portion 50 may provide smooth mating surfaces for seal 44, in order to generate a tight seal between cylinder liner 28 and engine block 22.

Because of high combustion pressures and intense reciprocating motion of piston 12, flange 40 may experiences high stresses. In addition, fastener 36 may increase stress at flange 40 during installation of cylinder liner 28. Due to the proximity of fillets 46, 48 to flange 40, fillets 46, 48 are also high-stress regions that may act as fatigue crack initiation sites in cylinder liner 28. Typically, in prior art systems, fillets 46, 48 and straight portion 50 of cylinder liner 28 may be as-cast features of cylinder liner 28. Additionally, in some applications, shot-peening may be used on fillets 46, 48 after casting to induce compressive residual stresses in those areas. However, casting and/or shot-peening may be insufficient in these high-stress regions of cylinder liner 28. Specifically, casting and shot-peening may provide fewer compressive residual stresses than other machining operations. In addition, shot-peening may provide rougher surfaces and/or be inefficient in high-volume manufacturing. As a result, using only these machining operations may result in more rapid fatigue and/or cracking in these regions.

To overcome these difficulties, a roll-burnishing operation may be performed on fillets 46, 48 and/or straight portion 50. The roll-burnishing operation may involve a cylindrical roller (not shown) that is moved across surfaces of recess 42 at a substantially constant rate to produce smooth and consistent surfaces. It is contemplated that, in some embodiments, a single roller may be used to form fillets 46, 48 and/or straight portion 50. However, in other embodiments, multiple rollers may be used, if desired. A spindle (not shown) may also be used to rotate cylinder liner 28 during the roll-burnishing operation. The roll-burnishing may decrease roughness of the surfaces of cylinder liner 28 to assist with sealing. The roll-burnishing operation may also induce compressive residual stresses in cylinder liner 28 at shoulder 38. It is known that tensile residual stresses tend to accelerate fatigue crack initiation and propagation, and are therefore undesirable in a location that is prone to fatigue failure. Thus, by using the roll-burnishing operation, the residual stresses on the exposed surface of fillets 46, 48 and straight portion 50 of cylinder liner 28 may be transformed from tensile to compressive. The compressive residual stresses help delay fatigue crack initiation and propagation. Therefore, the roll-burnishing in these areas may improve fatigue life of the cylinder liner 28.

In some embodiments, the roll-burnishing operation may result in several unique dimensional features in shoulder 38. For example, the roll-burnishing operation may deform fillets 46, 48 and straight portion 50. In one embodiment, fillets 46, 48 and straight portion 50 may each have a deformation of about 0.05 mm after the roll-burnishing operation. The roll-burnishing operation may also produce a unique radius of curvature of each of fillets 46, 48. In some embodiments, fillets 46, 48 may have substantially the same radius of curvature. In other embodiments, fillet 48 may have a greater radius of curvature than fillet 46. In one embodiment, a radius of curvature $R_1$ of fillet 46 may be about 1.10 to 4.0 min (e.g., 1.14 mm), and a radius of curvature $R_2$ of fillet 48 may also be about 1.10 to 4.0 mm (e.g., about 1.14 mm). In this embodiment, a ratio of $R_1$ to $R_2$ may be about 1:1 to 1:3. Also in some embodiments, a length of straight portion 50 may be about 1 to 8 mm (e.g., about 6 mm). Further, in some embodiments, a depth of recess 42 may be about 1 to 2 mm (e.g., about 2 mm). These dimensional features of shoulder 38 may induce compressive residual stresses in these high-stress regions, thereby delaying fatigue crack initiation and propagation in these areas. In addition, these dimensional features may provide smooth mating surfaces for seal 44 that provide a tight seal and help prevent water and/or oil from leaking into combustion chamber 18. In particular, if a ratio of $R_1$ to $R_2$ is higher or lower than the desired ratios, recess 42 may provide an uneven mating surface for seal 44, which can lead to leakage of water and/or oil into combustion chamber 18.

Figure 4:
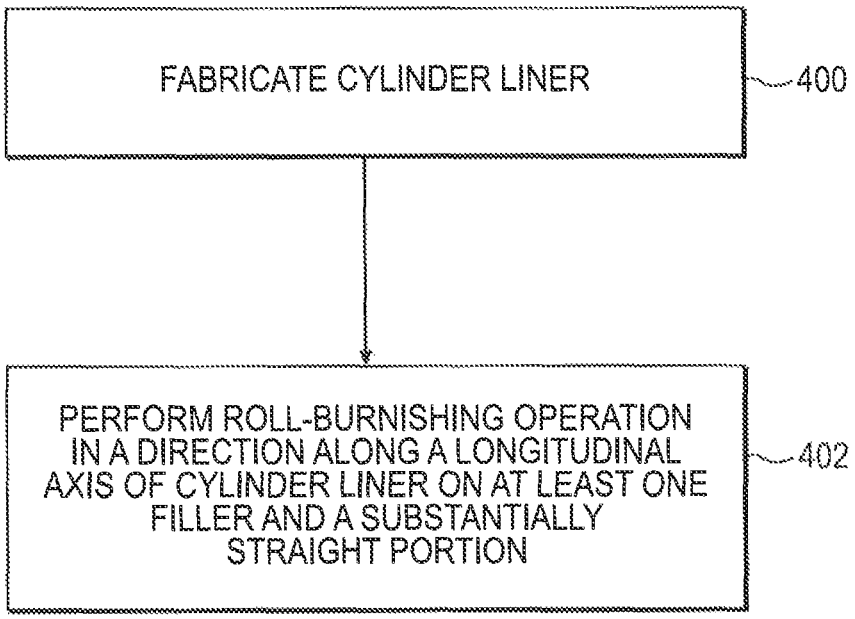
FIG. 4 is a flow chart illustrating an exemplary disclosed method of making the cylinder liner of FIG. 2.

FIG. 4 illustrates an exemplary method that may be used to make cylinder liner 28. FIG. 4 will be discussed in more detail in the following section to further illustrate the disclosed concepts.

INDUSTRIAL APPLICABILITY

The disclosed cylinder liner may be used in any application where it is desired to increase the reliability and operating life of the associated engine. The disclosed cylinder liner may include at least one fillet and a straight portion that are formed by a roll-burnishing operation to provide compressive residual stresses in a high stress region of the cylinder liner. The compressive residual stresses may help to delay fatigue crack initiation and propagation in these high stress regions. An exemplary method of creating the disclosed cylinder liner will now be described.

Referring to FIG. 4, cylinder liner 28 may be first fabricated through any known process (step 400). For example, cylinder liner 28 may be sand-cast from gray iron. The as-cast cylinder liner 28 may already include a rough outline of recess 42. In some embodiments, in place of fabricating a new cylinder liner 28, a previously used cylinder liner 28 may be refurbished. In these embodiments, the previously used cylinder liner 28 may be cleaned, and its surfaces (especially recess 42) prepared for additional machining operations. Preparation of the surfaces may involve degreasing and removal of remnants, if any, from the surfaces of cylinder liner 28.

A roll-burnishing operation may then be performed on shoulder 38 to induce compressive residual stresses within recess 42. Specifically, the roll-burnishing operation may be performed on at least one of fillets 46, 48 and straight portion 50 of recess 42 (step 402). In one embodiment, the roll-burnishing operation may be performed on both fillets 46, 48. The roll-burnishing operation may also be performed on straight portion 50 in a direction along longitudinal axis 32 (shown in FIG. 2) of cylinder liner 28.

In some embodiments, cylinder liner 28 may be positioned on the spindle, and be rotated by the spindle at a high speed. Then, the roller may be pressed against cylinder liner 28 at fillet 48, and be moved in a direction along longitudinal axis 32 toward flange 40 as it is presses against straight portion 50 and fillet 46. The roller may continue this process until the desired depth of deformation (e.g., about 0.05 mm) is achieved at the surfaces of fillets 46, 48 and straight portion 50. It is contemplated that, in some embodiments, this process may take multiple passes to achieve the desired depth. However, in other embodiments, a single stroke passing from fillet 46, through straight portion 50, and to fillet 48 may be used to roll-burnish all of these surfaces. In this embodiment, since these surfaces may all be formed without an additional process step, cost may be reduced. It is further contemplated that cylinder liner may be heated and/or lubricated to assist the roll-burnishing operation, if desired.

As discussed above, since the residual stress state at fillets 46, 48 and straight portion 50 may be compressive, initiation (if any) of a fatigue crack in this region should be delayed. Fatigue life of the cylinder liner 28 may thus be improved.

It will be apparent to those skilled in the art that various modifications and variations can be made to the disclosed cylinder liner. Other embodiments will be apparent to those skilled in the art from consideration of the specification and practice of the disclosed cylinder liner. It is intended that the specification and examples be considered as exemplary only, with a true scope being indicated by the following claims and their equivalents.

What is claimed is:

1. A method of making a cylinder liner, comprising:

fabricating a hollow generally cylindrical body that extends from a top end to a bottom end along a longitudinal axis, the cylindrical body including an annular flange extending radially outwardly from the top end of the body and an annular recess adjacent the flange at a side closest to the bottom end of the cylindrical body; and inducing compressive residual stresses on the annular recess by performing a roll-burnishing operation in a direction along the longitudinal axis on the annular recess, wherein performing the roll-burnishing operation in the direction along the longitudinal axis on the annular recess includes performing the roll-burnishing operation in the direction along a surface of a straight portion of the annular recess parallel to the longitudinal axis.

2. The method of claim 1, wherein performing the roll-burnishing operation in the direction along the longitudinal axis on the annular recess includes performing the roll-burnishing operation in the direction along the longitudinal axis on at least one fillet located at an axial end of the straight portion.

3. The method of claim 2, wherein performing the roll-burnishing operation in the direction along the longitudinal axis on the at least one fillet includes performing the roll-burnishing operation in the direction along the longitudinal axis on two fillets at opposing axial ends of the straight portion.

4. The method of claim 3, wherein performing the roll-burnishing operation in the direction along the longitudinal axis on two fillets includes performing the roll-burnishing operation to form the two fillets with substantially the same radius of curvature.

5. The method of claim 2, wherein performing the roll-burnishing operation along the longitudinal axis includes rolling the at least one fillet and the straight portion in a single stroke in the direction along the longitudinal axis.

* * * * *